US005288581A

United States Patent [19]

Ziolo

[11] Patent Number: 5,288,581

[45] Date of Patent: Feb. 22, 1994

[54] TONER COMPOSITIONS WITH ANIONIC CLAY OR CLAY-LIKE CHARGE ENHANCING ADDITIVES

[75] Inventor: Ronald F. Ziolo, Webster, N.Y.

[73] Assignee: Xerox Corporation, Stamford, Conn.

[21] Appl. No.: 885,589

[22] Filed: May 19, 1992

[51] Int. Cl.[5] ..... G03G 9/097

[52] U.S. Cl. ..... 430/110; 430/106.6

[58] Field of Search ..... 430/105, 109, 110, 106.6

[56] References Cited

U.S. PATENT DOCUMENTS 4,111,974 9/1978 Mazour et al. ..... 260/448.8 R 4,298,672 11/1981 Lu ..... 430/108

4,338,390 7/1982 Lu ..... 430/106

4,560,635 12/1985 Hoffend et al. ..... 430/106.6

4,770,934 9/1988 Yamasaki et al. ..... 428/331

4,843,168 6/1989 Drezdzon et al. ..... 558/357

FOREIGN PATENT DOCUMENTS 3245153A 2/1990 Japan .

*Primary Examiner*—John Goodrow

*Attorney, Agent, or Firm*—E. O. Palazzo

[57] ABSTRACT

A negatively charged toner composition comprised of resin particles, pigment particles, and a hydrotalcite charge enhancing additive.

21 Claims, No Drawings

TONER COMPOSITIONS WITH ANIONIC CLAY OR CLAY-LIKE CHARGE ENHANCING ADDITIVES

BACKGROUND OF THE INVENTION

The invention is generally directed to toner and developer compositions, and more specifically, the present invention is directed to developer and toner compositions containing charge enhancing additives, which impart or assist in imparting a negative charge to the toner resin particles and enable toners with rapid admix characteristics. In one embodiment, there are provided in accordance with the present invention toner compositions comprised of resin particles, pigment particles, and clay or clay-like charge additives. In one embodiment, the present invention is directed to toners with charge additives of synthetic anionic clays or minerals that contain exchangeable anions. These materials encompass, for example, the layered double hydroxides or mixed metal hydroxides of the general formula $$M_a^{2+}M_b^{3+}(OH)_{2a+2b}(X^{n-})_{2/n}\cdot xH_2O$$

where $M^{2+}$may be $Mg^{2+}$, $Fe^{2+}$, $Co^{2+}$, $Ni^{2+}$, $Zn^{2+}$, and the like; $M^{3+}$may be $Al^{3+}$, $Cr^{3+}$, $Fe^{3+}$, and the like; and X may be any anion such as a halide $Cl^-$, $Br^-$, $I^-$, and the like, a pseudohalide such as $NCS^-$, $N_3^-$ and the like, other inorganic anions such as $SO_4^{2-}$, $NO_3^{2-}$, $CO_3^{2-}$, $PO_4^{3-}$, and the like, organic anions such as salicylate, lauryl sulfate, dodecylsulfonate, terephthalate, and the like, polyoxometalate anions such as $(Mo_7O_{24})^{6-}$, $(W_7O_{24})^{6-}$, $(V_{10}O_{28})^{6-}$ and the like, polyoxometalate anions of the Keggin type structure such as $\alpha$-$(H_2W_{12}O_{40})^{6-}$, $\alpha$-$(SiV_3W_9O_{40})^{7-}$ and the like; n is the charge on the anion which in embodiments would generally range from 1 to about 4; a and b are subscripts indicating the amount of metal in the divalent and trivalent states; a may, for example, range from 1 to about 6 while b may, for example, range from 1 to about 3; and X may, for example, range from 0 to about 6. These materials also include the hydrotalcites which can be considered mixed metal hydroxides of the formulas $Mg_6Al_2(OH)_{16}CO_3.4H_2O$, $Mg_{4.5}Al_2(OH)_{13}(CO_3)$ and $Mg_{4.5}Al_2(OH)_{11}(CO_3)_{0.8}O_{0.2}$. Structurally, these materials can be considered as being comprised of positively charged brucite-like layers of $[Mg_6Al_2(OH)_{16}]^{2+}$ and negatively charged interlayers of $4H_2O$ and $[CO_3]^{2-}$, and wherein the interlayer carbonate ions are exchangeable, for example, with a halide such as chloride. The aforementioned additives in embodiments of the present invention enable, for example, toners with rapid admix of less than about 60 seconds, extended developer life, stable electrical properties, and high image print quality with substantially no background deposits. Also, the aforementioned toner compositions usually contain pigment particles comprised of, for example, carbon black, magnetites, or mixtures thereof, cyan, magenta, yellow, blue, green, red, or brown components, or mixtures thereof, thereby providing for the development and generation of black and/or colored images. The toner and developer compositions of the present invention can be selected for electrophotographic, especially xerographic imaging and printing processes, including color processes.

Developer compositions with charge enhancing additives, which impart a positive charge to the toner resin, are well known. Thus, for example, there is described in U.S. Pat. Nos. 3,893,935 the use of quaternary ammonium salts as charge control agents for electrostatic toner compositions; 4,221,856 which discloses electrophotographic toners containing resin compatible quaternary ammonium compounds in which at least two R radicals are hydrocarbons having from 8 to about 22 carbon atoms, and each other R is a hydrogen or hydrocarbon radical with from 1 to about 8 carbon atoms, and A is an anion, for example sulfate, sulfonate, nitrate, borate, chlorate, and the halogens such as iodide, chloride and bromide, reference the Abstract of the Disclosure and column 3; a similar teaching is presented in U.S. Pat. No. 4,312,933 which is a division of U.S. Pat. No. 4,291,111; and similar teachings are presented in U.S. Pat. No. 4,291,112 wherein A is an anion including, for example, sulfate, sulfonate, nitrate, borate, chlorate, and the halogens. There are also described in U.S. Pat. No. 2,986,521 reversal developer compositions comprised of toner resin particles coated with finely divided colloidal silica. According to the disclosure of this patent, the development of electrostatic latent images on negatively charged surfaces is accomplished by applying a developer composition having a positively charged triboelectric relationship with respect to the colloidal silica.

Also, there is disclosed in U.S. Pat. No. 4,338,390, the disclosure of which is totally incorporated herein by reference, developer compositions containing as charge enhancing additives organic sulfate and sulfonates, which additives can impart a positive charge to the toner composition. Further, there is disclosed in U.S. Pat. No. 4,298,672, the disclosure of which is totally incorporated herein by reference, positively charged toner compositions with resin particles and pigment particles, and as charge enhancing additives alkyl pyridinium compounds. Additionally, other documents disclosing positively charged toner compositions with charge control additives include U.S. Pat. Nos. 3,944,493; 4,007,293; 4,079,014; 4,394,430 and 4,560,635 which illustrates a toner with a distearyl dimethyl ammonium methyl sulfate charge additive.

Moreover, toner compositions with negative charge enhancing additives are known, reference for example U.S. Pat. Nos. 4,411,974 and 4,206,064, the disclosures of which are totally incorporated herein by reference. The '974 patent discloses negatively charged toner compositions comprised of resin particles, pigment particles, and as a charge enhancing additive ortho-halo phenyl carboxylic acids. Similarly, there are disclosed in the '064 patent toner compositions with chromium, cobalt, and nickel complexes of salicylic acid as negative charge enhancing additives.

There is illustrated in U.S. Pat. No. 4,404,271 a complex system for developing electrostatic images with a toner which contains a metal complex represented by the formula in column 2, for example, and wherein ME can be chromium, cobalt or iron. Additionally, other patents disclosing various metal containing azo dyestuff structures wherein the metal is chromium or cobalt include U.S. Pat. Nos. 2,891,939; 2,871,233; 2,891,938; 2,933,489; 4,053,462 and 4,314,937. Also, in U.S. Pat. No. 4,433,040, the disclosure of which is totally incorporated herein by reference, there are illustrated toner compositions with chromium and cobalt complexes of azo dyes as negative charge enhancing additives.

Disclosed in Hitachi Japanese Abstract JO 3245-153A, published Oct. 31, 1991, are toners with hydrotalcite compounds.

Although many charge enhancing additives are known, there continues to be a need for toners with additives, which toners possess many of the advantages illustrated herein. Additionally, there is a need for negative charge enhancing additives which are useful for incorporation into black, and/or colored toner compositions. Moreover, there is a need for colored toner compositions containing certain charge enhancing additives. There is also a need for toner compositions with certain charge enhancing additives, which toners in embodiments thereof may possess acceptable substantially stable triboelectric charging characteristics, and excellent admixing properties. Further, there is a need for toners with certain charge enhancing additives which can be easily and permanently dispersed into toner resin particles. There also is a need for negatively charged black, and colored toner compositions that are useful for incorporation into various imaging processes, inclusive of color xerography, as illustrated in U.S. Pat. No. 4,078,929, the disclosure of which is totally incorporated herein by reference; laser printers; and additionally a need for toner compositions useful in imaging apparatuses having incorporated therein layered photoresponsive imaging members, such as the members illustrated in U.S. Pat. No. 4,265,990, the disclosure of which is totally incorporated herein by reference. Also, there is a need for toner compositions which have the desired triboelectric charge level, for example, from about 10 to about 40 microcoulombs per gram, and preferably from about 10 to about 25 microcoulombs per gram, and admix charging rates of from about 5 to about 60 seconds, and preferably from about 15 to about 30 seconds, as determined by the charge spectrograph, preferably for example at low concentrations, that is for example less than 1 percent, and preferably less than about 0.5 percent of the charge enhancing additive of the present invention. Important advantages associated with the charge additives of the present invention is their white color, thus for example they do not adversely effect the intensity and hue of colored toners with, for example, cyan, magenta, yellow, green, red, blue, brown pigments or mixtures thereof, and that the clay charge additives do not contain toxic heavy metal ions such as chromium.

SUMMARY OF THE INVENTION

It is an object of the present invention to provide toner and developer compositions with charge enhancing additives.

In another object of the present invention there are provided negatively charged toner compositions useful for the development of electrostatic latent images including color images.

In yet a further object of the present invention there may be provided, it is believed, humidity insensitive from about, for example, 20 to 80 percent relative humidity at temperatures of from 60° to 80° F. as determined in a relative humidity testing chamber, negatively charged toner compositions with desirable admix properties of 5 seconds to 60 seconds as determined by the charge spectrograph, and preferably less than 15 seconds for example, and more preferably from about 1 to about 14 seconds, and acceptable triboelectric charging characteristics of from about a negative 10 to about a negative 40 microcoulombs per gram.

Another object of the present invention resides in the formation of toners which will enable the development of images in electrophotographic imaging apparatuses, which images have substantially no background deposits thereon, are substantially smudge proof or smudge resistant, and therefore, are of excellent resolution; and further, such toner compositions can be selected for high speed electrophotographic apparatuses, that is those exceeding 70 copies per minute.

In embodiments of the present invention there are provide toner compositions comprised of resin particles, pigment particles, and hydrotalcite charge enhancing additives. More specifically, the present invention in one embodiment is directed to toner compositions comprised of resin, pigment, or dye, and a hydrotalcite negative charge enhancing additive. The aforementioned charge additive can be incorporated into the toner, may be present on the toner surface or may be present on toner surface additives such as colloidal silica particles. Advantages of rapid admix, appropriate triboelectric characteristics, and the like, it is believed, can be achieved with many of the aforementioned toners of the present invention. In another embodiment of the present invention, there is provided, subsequent to known micronization and classification, to enable toner particles with an average diameter of from about 10 to about 20 microns.

The charge additives of the present invention, which are known materials, may be made by known methods, reference for example, W. T. Reichle, *Solid State Ionics*, vol. 22, 1986, pages 135 to 141; U.S. Pat. No. 4,843,168; W. T. Reichle et al., *Journal of Catalysis*, vol. 101, 1986, pages 352 to 359; W. T. Reichle, *Chemtech*, January, 1986, pages 58 to 63; T. Kwonn et al., *Chemistry of Materials*, vol. 1, 1989, page 381, and S. Miyata, *Clays and Clay Minerals*, vol. 31, 1983, page 305, the disclosures of which are totally incorporated herein by reference. The hydrotalcites of the following formulas are preferred in embodiments $Mg_{4.5}Al_2(OH)_{13}(CO_3)_{.3.5}H_2O$, $Mg_{4.5}Al_2(OH)_{13}(CO_3)$ and $Mg_{4.5}Al_2(OH)_{11}(CO_3)_{0.8}O_{0.2}$, and they may be obtained from Kyowa Chemical Industry Company, Ltd., Takamatsu, Kagawa, Japan. Examples of other specific charge additives include $Mg_{4.5}Al_2(OH)_{13}Cl_{2.\ 3.5}H_2O$, $Mg_{4.5}Al_2(OH)_{13}Cl_2$, $Mg_{4.5}Al_2(OH)_{13}Br_{2.\ 3.5}H_2O$, $Mg_{4.5}Al_2(OH)_{13}Br_2$, $Mg_{4.5}Al_2(OH)_{132}l_{2.\ 3.5}HO$, $Mg_{4.5}Al_2(OH)_{13}l_2$, $Zn_2Al(OH)_6NO_3$, $Zn_2Al(OH)_6Cl$, $Zn_2Al(OH)_6(C_7H_5O_3)$, $Zn_2Al(OH)_6(C_{12}H_{25}SO_4)$, $Mg_{4.5}Al_2(OH)_{13}SO_{4.\ 3.5}H_2O$, and $Mg_{4.5}Al_2(OH)_{13}SO_4$.

The toner compositions of the present invention can be prepared by a number of known methods such as admixing and heating resin particles such as styrene butadiene copolymers, pigment particles such as magnetite, carbon black, or mixtures thereof, and preferably from about 0.5 percent to about 5 percent of the aforementioned charge enhancing additives, or mixtures of charge additives, in a toner extrusion device, such as the ZSK53 available from Werner Pfleiderer, and removing the formed toner composition from the device. Subsequent to cooling, the toner composition is subjected to grinding utilizing, for example, a Sturtevant micronizer for the purpose of achieving toner particles with a volume median diameter of less than about 25 microns, and preferably of from about 8 to about 12 microns, which diameters are determined by a Coulter Counter. Subsequently, the toner compositions can be classified utilizing, for example, a Donaldson Model B classifier for the purpose of removing fines, that is toner particles less than about 4 microns volume median diameter.

Illustrative examples of suitable toner resins selected for the toner and developer compositions of the present invention include polyamides, polyolefins, styrene acrylates, styrene methacrylates, styrene butadienes, crosslinked styrene polymers, epoxies, polyurethanes, vinyl resins, including homopolymers or copolymers of two or more vinyl monomers; and polymeric esterification products of a dicarboxylic acid and a diol comprising a diphenol. Vinyl monomers include styrene, p-chlorostyrene, unsaturated mono-olefins such as ethylene, propylene, butylene, isobutylene and the like; saturated mono-olefins such as vinyl acetate, vinyl propionate, and vinyl butyrate; vinyl esters like esters of monocarboxylic acids including methyl acrylate, ethyl acrylate, n-butylacrylate, isobutyl acrylate, dodecyl acrylate, n-octyl acrylate, phenyl acrylate, methyl methacrylate, ethyl methacrylate, and butyl methacrylate; acrylonitrile, methacrylonitrile, acrylamide; mixtures thereof; and the like, styrene butadiene copolymers; with a styrene content of from about 70 to about 95 weight percent, reference the U.S. patents mentioned herein, the disclosures of which have been totally incorporated herein by reference. In addition, crosslinked resins, including polymers, copolymers, and homopolymers of the aforementioned styrene polymers may be selected.

As one toner resin, there are selected the esterification products of a dicarboxylic acid and a diol comprising a diphenol. These resins are illustrated in U.S. Pat. No. 3,590,000, the disclosure of which is totally incorporated herein by reference. Other specific toner resins include styrene/methacrylate copolymers, and styrene/butadiene copolymers; PLIOLITES ®; suspension polymerized styrene butadienes, reference U.S. Pat. No. 4,558,108, the disclosure of which is totally incorporated herein by reference; polyester resins obtained from the reaction of bisphenol A and propylene oxide; followed by the reaction of the resulting product with fumaric acid, and branched polyester resins resulting from the reaction of dimethylterephthalate, 1,3-butanediol, 1,2-propanediol, and pentaerythritol, styrene acrylates, and mixtures thereof. Moreover the polyesters, especially those prepared by reactive extrusion as illustrated in copending patent applications U.S. Ser. No. 814,641, and U.S. Ser. No. 814,782, the disclosures of which are totally incorporated herein by reference, may also be selected as toner resin particles. Also, waxes with a molecular weight of from about 1,000 to about 6,000, such as polyethylene, polypropylene, and paraffin waxes, can be included in, or on the toner compositions as fuser roll release agents.

The resin particles are present in a sufficient, but effective amount, for example from about 70 to about 90 weight percent. Thus, when 1 percent by weight of the charge enhancing additive is present, and 10 percent by weight of pigment or colorant, such as carbon black, is contained therein, about 89 percent by weight of resin is selected. Also, the charge enhancing additive of the present invention may be coated on the pigment particle. When used as a coating, the charge enhancing additive of the present invention is present in an amount of from about 0.1 weight percent to about 5 weight percent, and preferably from about 0.3 weight percent to about 1 weight percent.

Numerous well known suitable pigments or dyes can be selected as the colorant for the toner particles including, for example, carbon black, like REGAL 330 ®, VULCAN TM carbon black, nigrosine dye, aniline blue, magnetite, or mixtures thereof. The pigment, which is preferably carbon black, should be present in a sufficient amount to render the toner composition highly colored. Generally, the pigment particles are present in amounts of from about 1 percent by weight to about 20 percent by weight, and preferably from about 2 to about 10 weight percent based on the total weight of the toner composition; however, lesser or greater amounts of pigment particles can be selected providing the objectives of the present invention are achieved.

When the pigment particles are comprised of magnetites, thereby enabling single component toners in some instances, which magnetites are a mixture of iron oxides ($FeO.Fe_2O_3$) including those commercially available as MAPICO BLACK TM, they are present in the toner composition in an amount of from about 10 percent by weight to about 70 percent by weight, and preferably in an amount of from about 10 percent by weight to about 50 percent by weight. Mixtures of carbon black and magnetite with from about 1 to about 15 weight percent of carbon black, and preferably from about 2 to about 6 weight percent of carbon black, and magnetite, such as MAPICO BLACK TM, in an amount of, for example, from about 5 to about 60, and preferably from about 10 to about 50 weight percent can be selected.

There can also be blended with the toner compositions of the present invention external additive particles including flow aid additives, which additives are usually present on the surface thereof. Examples of these additives include colloidal silicas such as AEROSIL ®, metal salts and metal salts of fatty acids inclusive of zinc stearate, aluminum oxides, cerium oxides, and mixtures thereof, which additives are generally present in an amount of from about 0.1 percent by weight to about 5 percent by weight, and preferably in an amount of from about 0.1 percent by weight to about 1 percent by weight. Several of the aforementioned additives are illustrated in U.S. Pat. Nos. 3,590,000 and 3,800,588, the disclosures of which are totally incorporated herein by reference.

With further respect to the present invention, colloidal silicas such as AEROSIL ® can be combined with the charge additives of the present invention illustrated herein in an amount of from about 1 to about 30 weight percent and preferably 10 weight percent followed by the addition thereof to the toner in an amount of from 0.1 to 10 and preferably 0.1 to 1 weight percent.

Also, there can be included in the toner compositions of the present invention low molecular weight waxes, such as polypropylenes and polyethylenes commercially available from Allied Chemical and Petrolite Corporation, EPOLENE N-15 TM commercially available from Eastman Chemical Products, Inc., VISCOL 550-P TM, a low weight average molecular weight polypropylene available from Sanyo Kasei K. K., and similar materials. The commercially available polyethylenes selected have a molecular weight of from about 1,000 to about 1,500, while the commercially available polypropylenes utilized for the toner compositions of the present invention are believed to have a molecular weight of from about 4,000 to about 5,000. Many of the polyethylene and polypropylene compositions useful in the present invention are illustrated in British Patent No. 1,442,835, the disclosure of which is totally incorporated herein by reference.

The low molecular weight wax materials are present in the toner composition of the present invention in various amounts, however, generally these waxes are present in the toner composition in an amount of from about 1 percent by weight to about 15 percent by weight, and preferably in an amount of from about 2 percent by weight to about 10 percent by weight.

Furthermore, encompassed within the scope of the present invention are colored toner and developer compositions comprised of toner resin particles, optional carrier particles, the charge enhancing additives illustrated herein, and as pigments or colorants red, blue, green, brown, magenta, cyan and/or yellow particles, as well as mixtures thereof. More specifically, with regard to the generation of color images utilizing a developer composition with the charge enhancing additives of the present invention, illustrative examples of magenta materials that may be selected as pigments include, for example, 2,9-dimethyl-substituted quinacridone and anthraquinone dye identified in the Color Index as Cl 60710, Cl Dispersed Red 15, diazo dye identified in the Color Index as Cl 26050, Cl Solvent Red 19, and the like. Illustrative examples of cyan materials that may be used as pigments include copper tetra-4-(octadecyl sulfonamido) phthalocyanine, X-copper phthalocyanine pigment listed in the Color Index as Cl 74160, Cl Pigment Blue, and Anthrathrene Blue, identified in the Color Index as Cl 69810, Special Blue X-2137, and the like; while illustrative examples of yellow pigments that may be selected are diarylide yellow 3,3-dichlorobenzidene acetoacetanilides, a monoazo pigment identified in the Color Index as Cl 12700, Cl Solvent Yellow 16, a nitrophenyl amine sulfonamide identified in the Color Index as Foron Yellow SE/GLN, Cl Dispersed Yellow 33, 2,5-dimethoxy-4-sulfonanilide phenylazo-4'-chloro-2,5-dimethoxy acetoacetanilide, and Permanent Yellow FGL. The aforementioned pigments are incorporated into the toner composition in various suitable effective amounts providing the objectives of the present invention are achieved. In one embodiment, these colored pigment particles are present in the toner composition in an amount of from about 2 percent by weight to about 15 percent by weight calculated on the weight of the toner resin particles.

For the formulation of developer compositions, there are mixed with the toner particles carrier components, particularly those that are capable of triboelectrically assuming an opposite polarity to that of the toner composition. Accordingly, the carrier particles of the present invention are selected to be of a negative polarity enabling the toner particles, which are positively charged, to adhere to and surround the carrier particles. Illustrative examples of carrier particles include iron powder, steel, nickel, iron, ferrites, including copper zinc ferrites, and the like. Additionally, there can be selected as carrier particles nickel berry carriers as illustrated in U.S. Pat. No. 3,847,604, the disclosure of which is totally incorporated herein by reference. The selected carrier particles can be used with or without a coating, the coating generally containing terpolymers of styrene, methylmethacrylate, and a silane, such as triethoxy silane, reference U.S. Pat. Nos. 3,526,533 and 3,467,634, the disclosures of which are totally incorporated herein by reference; polymethyl methacrylates; other known coatings; and the like. The carrier particles may also include in the coating, which coating can be present in one embodiment in an amount of from about 0.1 to about 3 weight percent, conductive substances such as carbon black in an amount of from about 5 to about 30 percent by weight. Polymer coatings not in close proximity in the triboelectric series can also be selected, reference U.S. Pat. Nos. 4,937,166 and 4,935,326, the disclosures of which are totally incorporated herein by reference, including for example KYNAR ® and polymethylmethacrylate mixtures (40/60). Coating weights can vary as indicated herein; generally, however, from about 0.3 to about 2, and preferably from about 0.5 to about 1.5 weight percent coating weight is selected.

Furthermore, the diameter of the carrier particles, preferably spherical in shape, is generally from about 50 microns to about 1,000 microns thereby permitting them to possess sufficient density and inertia to avoid adherence to the electrostatic images during the development process. The carrier component can be mixed with the toner composition in various suitable combinations, however, best results are obtained when about 1 to 5 parts per toner to about 100 parts to about 200 parts by weight of carrier are selected.

The toner composition of the present invention can be prepared by a number of known methods including extrusion melt blending the toner resin particles, pigment particles or colorants, and the charge enhancing additive of the present invention as indicated herein, followed by mechanical attrition and classification. Other methods include those well known in the art such as spray drying, melt dispersion, extrusion processing, dispersion polymerization, and suspension polymerization. Also, as indicated herein the toner composition without the charge enhancing additive can be prepared, followed by the addition of surface treated with charge additive colloidal silicas. Further, other methods of preparation for the toner are as illustrated herein.

The toner and developer compositions of the present invention may be selected for use in electrostatographic imaging apparatuses containing therein conventional photoreceptors providing that they are capable of being charged negatively. Thus, the toner and developer compositions of the present invention can be used with layered photoreceptors that are capable of being charged negatively, such as those described in U.S. Pat. No. 4,265,990, the disclosure of which is totally incorporated herein by reference, and wherein the background areas are developed.

The toners of the present invention are usually jetted and classified subsequent to preparation to enable toner particles with a preferred average diameter of from about 5 to about 25 microns, and more preferably from about 8 to about 12 microns. Also, the toner compositions of the present invention preferably possess a negative triboelectric charge of from about 10 to about 40 microcoulombs per gram in embodiments thereof as determined by the known charge spectograph. Admix time for the toners of the present invention are preferably from about 5 seconds to 1 minute, and more specifically from about 5 to about 15 seconds in embodiments thereof as determined by the known charge spectograph. These toner compositions with rapid admix characteristics enable, for example, the development of images in electrophotographic imaging apparatuses, which images have substantially no background deposits thereon, even at high toner dispensing rates in some instances, for instance exceeding 20 grams per minute; and further, such toner compositions can be selected for high speed electrophotographic apparatuses, that is those exceeding 70 copies per minute.

A number of advantages are associated with the toners of the present invention such as for example, stable triboelectrical charges, excellent admix characteristics, substantial humidity insensitivity, minimal adverse effects when the charge additives are utilized with colored toners, reference Examples III and IV, substantially free of toxicity, and the like.

The following Examples are being supplied to further define various species of the present invention, it being noted that these Examples are intended to illustrate and not limit the scope of the present invention. Parts and percentages are by weight unless otherwise indicated.

EXAMPLE I

There is prepared in an extrusion device, available as ZSK28 from Werner Pfleiderer, a toner composition by adding thereto 91 percent by weight of suspension polymerized styrene butadiene copolymer resin particles (87/13), reference U.S. Pat. No. 4,558,108, the disclosure of which is totally incorporated herein by reference; 8 percent by weight of REGAL 330® carbon black; and 1 percent by weight of the charge enhancing additive hydrotalcite obtained from Kyowa Chemical Industry Company, Ltd. and believed to be of the formula $Mg_{4.5}Al_2(OH)_{13}(CO_3)$. The toner product, which is extruded at a rate of 15 pounds per hour, reached a melting temperature of 410° F. The strands of melt mixed product exiting from the extruder are cooled by immersing them in a water bath maintained at room temperature, about 25° C. Subsequent to air drying, the resulting toner was subjected to grinding in a Sturtevant micronizer enabling particles with a volume median diameter of from 8 to 12 microns as measured by a Coulter Counter. Thereafter, the aforementioned toner particles are classified in a Donaldson Model B classifier for the purpose of removing fine particles, that is those with a volume median diameter of less than 4 microns.

Subsequently, the above formulated toner, 3 parts by weight, is mixed with 97 parts by weight of a carrier containing a steel core with a polymer mixture thereof, 0.70 percent by weight, which polymer mixture contained 30 parts by weight of polyvinylidene fluoride, and 70 parts by weight of polymethyl methacrylate, and wherein mixing was accomplished in a paint shaker for 10 minutes. There results on the toner composition, as determined in the known Faraday Cage apparatus, a negative triboelectric charge of 21 microcoulombs per gram.

There is then added to the above prepared developer composition 1 part by weight of an uncharged toner comprised of 90 percent by weight of suspension polymerized styrene butadiene copolymer resin particles (87/13), reference U.S. Pat. No. 4,558,108, the disclosure of which is totally incorporated herein by reference; 9 percent by weight of REGAL 330® carbon black; and 1 percent by weight of the above negative charge enhancing additive. Thereafter, the charge distribution of the resulting developer is measured as a function of the mixing time, and it was determined by a charge spectrograph that the admixing time is about 15 seconds for this added uncharged toner.

EXAMPLE II

There is prepared in an extrusion device, available as ZSK28 from Werner Pfleiderer, a toner composition by adding thereto 91 percent by weight of suspension polymerized styrene butadiene copolymer resin particles (87/13), reference U.S. Pat. No. 4,558,108, the disclosure of which is totally incorporated herein by reference; 8 percent by weight of REGAL 330® carbon black; and 1 percent by weight of the charge enhancing additive hydrotalcite obtained from Kyowa Chemical Industry Company, Ltd. and believed to be of the formula $Mg_{4.5}Al_2(OH)_{11}(CO_3)_{0.8}O_{0.2}$. The toner product, which is extruded at a rate of 15 pounds per hour and attained a melting temperature of 410° F. The strands of melt mixed product exiting from the extruder are cooled by immersing them in a water bath maintained at room temperature, about 25° C. Subsequent to air drying, the resulting toner is subjected to grinding in a Sturtevant micronizer enabling particles with a volume median diameter of from 8 to 12 microns as measured by a Coulter Counter. Thereafter, the aforementioned toner particles are classified in a Donaldson Model B classifier for the purpose of removing fine particles, that is those with a volume median diameter of less than 4 microns.

Subsequently, the above formulated toner, 3 parts by weight, is mixed with 97 parts by weight of a carrier containing a steel core with a polymer mixture thereof, 0.70 percent by weight, which polymer mixture contained 30 parts by weight of polyvinylidene fluoride, and 70 parts by weight of polymethyl methacrylate, and wherein mixing is accomplished in a paint shaker for 10 minutes. There results on the toner composition, as determined in the known Faraday Cage apparatus, a negative triboelectric charge of 22 microcoulombs per gram.

There is then added to the above prepared developer composition 1 part by weight of an uncharged toner comprised of 90 percent by weight of suspension polymerized styrene butadiene copolymer resin particles (87/13), reference U.S. Pat. No. 4,558,108, the disclosure of which is totally incorporated herein by reference; 9 percent by weight of Regal 330® carbon black; and 1 percent by weight of the above negative charge enhancing additive. Thereafter, the charge distribution of the resulting developer is measured as a function of the mixing time, and it is determined by a charge spectrograph that the admixing time is about 15 seconds for the added uncharged components of resin and charge additive.

EXAMPLE III

There was prepared in an extrusion device, available as ZSK28 from Werner Pfleiderer, a toner resin composition of 100 percent by weight of suspension polymerized styrene butadiene copolymer resin particles (87/13), reference U.S. Pat. No. 4,558,108, the disclosure of which is totally incorporated herein by reference. The toner resin product, which was extruded at a rate of 15 pounds per hour, reached a melting temperature of 410° F. The strands of melt mixed product exiting from the extruder were cooled by immersing them in a water bath maintained at room temperature, about 25° C. Subsequent to air drying, the resulting toner resin was subjected to grinding in a Sturtevant micronizer enabling polymer resin particles with a volume median diameter of from 8 to 12 microns as measured by a Coulter Counter. Thereafter, the aforementioned polymer particles were classified in a Donaldson Model B classifier for the purpose of removing fine particles, that is those with a volume median diameter of less than 4 microns.

The above prepared polymer was then surface treated with 0.5 percent by weight of the surface charge enhancing additive hydrotalcite obtained from Kyowa Chemical Industry Company, Ltd. by combining 0.063 gram of $Mg_{4.5}Al_2(OH)_{13}(CO_3)$ synthetic hydrotalcite, 125 grams of ¼ inch steel shot and 12.5 grams of the above prepared styrene butadiene toner resin in a 4 ounce bottle which was then roll milled for 30 minutes at 90 feet/minute.

Subsequently, the above formulated toner polymer charge enhancing additive product, 3 parts by weight, was mixed with 97 parts by weight of a carrier containing a steel core with a polymer mixture thereof, 0.70 percent by weight, which polymer mixture contained 30 parts by weight of polyvinylidene fluoride, and 70 parts by weight of polymethyl methacrylate, and wherein mixing was accomplished by roll milling in a 2 ounce jar for one hour at 90 feet/minute. There resulted on the toner polymer charge enhancing additive product composition, as determined in the known Faraday Cage apparatus, a negative triboelectric charge of 21 microcoulombs per gram.

There was then added to the above prepared developer composition 1 part by weight of an uncharged mixture comprised of 99.5 percent by weight of suspension polymerized styrene butadiene copolymer resin particles (87/13), reference U.S. Pat. No. 4,558,108, the disclosure of which is totally incorporated herein by reference; and 0.5 percent by weight of the above negative charge enhancing additive. Thereafter, the charge distribution of the resulting developer was measured as a function of the mixing time, and it was determined by a charge spectrograph that the admixing time was about 15 seconds for the uncharged mixture of polymer and charge additive.

EXAMPLE IV

There was prepared in an extrusion device, available as ZSK28 from Werner Pfleiderer, a toner resin composition of 100 percent by weight of suspension polymerized styrene butadiene copolymer resin particles (87/13), reference U.S. Pat. No. 4,558,108, the disclosure of which is totally incorporated herein by reference. The polymer product, which was extruded at a rate of 15 pounds per hour, reached a melting temperature of 410° F. The strands of melt mixed product exiting from the extruder were cooled by immersing them in a water bath maintained at room temperature, about 25° C. Subsequent to air drying, the resulting polymer was subjected to grinding in a Sturtevant micronizer enabling particles with a volume median diameter of from 8 to 12 microns as measured by a Coulter Counter. Thereafter, the aforementioned polymer particles were classified in a Donaldson Model B classifier for the purpose of removing fine particles, that is those with a volume median diameter of less than 4 microns.

The above prepared polymer was then surface treated with 0.5 percent by weight of the surface charge enhancing additive hydrotalcite, obtained from Kyowa Chemical Industry Company, Ltd., by combining 0.063 gram of $Mg_{4.5}Al_2(OH)_{11}(CO_3)_{0.8}O_{0.2}$ synthetic hydrotalcite, 125 grams of ¼ inch steel shot and 12.5 grams of the styrene butadiene toner resin in a 4 ounce bottle which was then roll milled for 30 minutes at 90 feet/minute.

Subsequently, the above formulated polymer, 3 parts by weight, was mixed with 97 parts by weight of a carrier containing a steel core with a polymer mixture thereof, 0.70 percent by weight, which polymer mixture contained 30 parts by weight of polyvinylidene fluoride, and 70 parts by weight of polymethyl methacrylate, and wherein mixing was accomplished by roll milling in a 2 ounce jar for one hour at 90 feet/minute. There resulted on the toner composition, as determined in the known Faraday Cage apparatus, a negative triboelectric charge of 22 microcoulombs per gram.

There was then added to the above prepared developer composition 1 part by weight of an uncharged composition comprised of 100 percent by weight of suspension polymerized styrene butadiene copolymer resin particles (87/13), reference U.S. Pat. No. 4,558,108, the disclosure of which is totally incorporated herein by reference; and 0.5 percent by weight of the above negative charge enhancing additive. Thereafter, the charge distribution of the resulting developer was measured as a function of the mixing time, and it was determined by a charge spectrograph that the admixing time was about 15 seconds for this added uncharged mixture.

EXAMPLE V

There was prepared in an extrusion device, available as ZSK28 from Werner Pfleiderer, a toner composition of 95.5 percent by weight of suspension polymerized styrene butadiene copolymer resin particles (87/13), reference U.S. Pat. No. 4,558,108, the disclosure of which is totally incorporated herein by reference, and 4.5 percent by weight of PV FAST BLUE TM, available from BASF. The toner product which was extruded at a rate of 15 pounds per hour reached a melting temperature of 410° F. The strands of melt mixed product exiting from the extruder were cooled by immersing them in a water bath maintained at room temperature, about 25° C. Subsequent to air drying, the resulting toner was subjected to grinding in a Sturtevant micronizer enabling particles with a volume median diameter of from 8 to 12 microns as measured by a Coulter Counter. Thereafter, the aforementioned toner particles were classified in a Donaldson Model B classifier for the purpose of removing fine particles, that is those with a volume median diameter of less than 4 microns.

The above prepared toner product was then surface treated with 0.5 percent by weight of the surface charge enhancing additive hydrotalcite, obtained from Kyowa Chemical Industry Company, Ltd., by combining 0.063 gram of $Mg_{4.5}Al_2(OH)_{13}(CO_3)\cdot_{3.5}H_2O$ synthetic hydrotalcite, 125 grams of ¼ inch steel shot and 12.5 grams of the styrene butadiene toner resin in a 4 ounce bottle which was then roll milled for 30 minutes at 90 feet/minute.

Subsequently, the above formulated toner, 2 parts by weight, was mixed with 98 parts by weight of a carrier containing a core with a polymer mixture thereof, 1.0 percent coating weight, which polymer mixture contained 60 weight percent of polyvinylidene fluoride and 40 weight percent of polymethacrylate, and wherein mixing was accomplished by roll milling in a 2 ounce jar for one hour at 90 feet/minute. There resulted on the toner composition, as determined in the known Faraday Cage apparatus, a negative triboelectric charge of 18 microcoulombs per gram.

There was then added to the above prepared developer composition 1 part by weight of an uncharged toner comprised of 95.5 percent by weight of suspension polymerized styrene butadiene copolymer resin particles (87/13), reference U.S. Pat. No. 4,558,108, the disclosure of which is totally incorporated herein by reference, and 4.5 percent by weight of PV FAST BLUE TM, available from BASF, and as a surface additive 0.5 percent by weight of the above negative charge enhancing additive. Thereafter, the charge distribution of the resulting developer was measured as a function of the mixing time, and it was determined by a charge spectrograph that the admixing time was about 30 seconds, for this added uncharged toner.

Other modifications of the present invention may occur to those skilled in the art subsequent to a review of the present application, and these modifications, including equivalents thereof, are intended to be included within the scope of the present invention.

What is claimed is:

1. A negatively charged toner composition comprised of resin particles, pigment particles, and a hydrotalcite charge enhancing additive comprised of metal oxides of the formula $Mg_6Al_2(OH)_{16}CO_3.4H_2O$, $Mg_{4.5}Al_2(OH)_{13}(CO_3)$, $Mg_{4.5}Al_2(OH)_{11}(CO_3)_{0.8}O_{0.2}$, or mixtures thereof.

2. A negatively charged toner composition consisting essentially of resin, pigment, and a hydrotalcite charge enhancing additive comprised of metal oxides of the formula $Mg_6Al_2(OH)_{16}CO_3.4H_2O$, $Mg_{4.5}Al_2(OH)_{13}(CO_3)$, $Mg_{4.5}Al_2(OH)_{11}(CO_3)_{0.8}O_{0.2}$, or mixtures thereof.

3. A negatively charged toner composition comprised of resin particles, pigment particles, and a hydrotalcite comprised of layered double hydroxides or mixed metal hydroxides of the general formula $$M_a^{2+}M_b^{3+}(OH)_{2a+2b}(X^{n-})_{2/n}\cdot xH_2O$$

wherein $M^{2+}$ is $Mg^{2+}$, $Fe^{2+}$, $Co^{2+}$, $Ni^{2+}$, $Zn^{2+}$, and the like, $M^{3+}$ may be $Al^{3+}$, $Cr^{3+}$, or $Fe^{3+}$; and X is an of $Cl^-$, $Br^-$, $I^-$, $NCS^-$, $N_3^-$, $SO_4^{2-}$, $NO_3^{2-}$, $CO_3^{2-}$, $PO_4^{3-}$, salicylate, lauryl sulfate, dodecylsulfonate, terephthalate, $(Mo_7O_{24})^{6-}$, $(W_7O_{24})^{6-}$, $(V_{10}O_{28})^{6-}$, $\alpha$-$(H_2W_{12}O_{40})^{6-}$, and $\alpha$-$(SiV_3W_9O_{40})^{7-}$.

4. A toner in accordance with claim 2 with an admix time of from about 15 to about 30 seconds.

5. A toner composition in accordance with claim 1 wherein the charge additive is present in an amount of from about 0.05 to about 5 weight percent.

6. A toner composition in accordance with claim 1 wherein the charge additive is present in an amount of from about 0.1 to about 1 weight percent.

7. A toner composition in accordance with claim 1 wherein the charge additive is incorporated into the toner.

8. A toner composition in accordance with claim 1 wherein the charge additive is present on the surface of the toner compositions.

9. A toner composition in accordance with claim 8 wherein the charge additive is contained on colloidal silica particles.

10. A toner composition in accordance with claim 1 with an admix time of from about 15 seconds to about 60 seconds.

11. A toner composition in accordance with claim 1 with a negative triboelectric charge of from between about 10 to about 40 microcoulombs per gram.

12. A toner composition in accordance with claim 1 wherein the resin particles are comprised of styrene polymers, polyesters, or mixtures thereof.

13. A toner composition in accordance with claim 1 wherein the resin particles are comprised of styrene acrylates, styrene methacrylates, or styrene butadienes.

14. A toner composition in accordance with claim 1 containing a wax component with a weight average molecular weight of from about 1,000 to about 6,000.

15. A toner composition in accordance with claim 14 wherein the waxy component is selected from the group consisting of polyethylene and polypropylene.

16. A toner composition in accordance with claim 1 containing as external additives metal salts of a fatty acid, colloidal silicas, or mixtures thereof.

17. A toner composition in accordance with claim 1 wherein the pigment particles are carbon black, magnetites, or mixtures thereof, cyan, magenta, yellow, red, blue, green, brown, and mixtures thereof.

18. A toner composition in accordance with claim 17 wherein the charge additive is present in an amount of from about 0.05 to about 5 weight percent.

19. A developer composition comprised of the toner composition of claim 1, and carrier particles.

20. A developer composition in accordance with claim 19 wherein the carrier particles are comprised of ferrites, steel, or an iron powder with a polymer, or mixtures of polymer coating thereover.

21. A developer composition in accordance with claim 20 wherein the coating is comprised of a methyl terpolymer, a polyvinylidine fluoride, a polymethyl methacrylate, or a mixture of polymers not in close proximity in the triboelectric series.

* * * * *